US011396876B2

(12) United States Patent
Maishigi et al.

(10) Patent No.: US 11,396,876 B2
(45) Date of Patent: Jul. 26, 2022

(54) CONTROL DEVICE, CONTROL SYSTEM, CONTROL METHOD, RECORDING MEDIUM AND MACHINE LEARNING DEVICE

(71) Applicant: EBARA CORPORATION, Tokyo (JP)

(72) Inventors: Keiji Maishigi, Toyko (JP); Tetsuro Sugiura, Tokyo (JP); Atsushi Shiokawa, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 364 days.

(21) Appl. No.: 16/432,836

(22) Filed: Jun. 5, 2019

(65) Prior Publication Data

US 2019/0368490 A1 Dec. 5, 2019

(30) Foreign Application Priority Data

Jun. 5, 2018 (JP) ..... JP2018-107889

(51) Int. Cl.
*F04C 28/28* (2006.01)
*F04C 13/00* (2006.01)
(Continued)

(52) U.S. Cl.
CPC ..... *F04C 28/06* (2013.01); *F04C 13/007* (2013.01); *F04C 15/0096* (2013.01);
(Continued)

(58) Field of Classification Search
CPC ..... F04C 28/06; F04C 2220/10; F04C 2240/403; F04C 2270/07; F04C 28/28;
(Continued)

(56) References Cited

U.S. PATENT DOCUMENTS 5,961,291 A * 10/1999 Sakagami ..... F04D 29/70 417/42
8,172,544 B2 * 5/2012 Kido ..... F04C 18/126 417/12
(Continued)

FOREIGN PATENT DOCUMENTS

CN 107942918 A 4/2018
CN 108696232 A * 10/2018 ..... B60N 2/0232
(Continued)

OTHER PUBLICATIONS

European Patent Application No. 19172750.2; Partial Search Report; dated Dec. 17, 2019; 18 pages.

*Primary Examiner* — Dominick L Plakkoottam
(74) *Attorney, Agent, or Firm* — BakerHostetler

(57) ABSTRACT

A control device that controls a target vacuum pump including a motor, including: a decision unit that decides, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and a control unit that controls the motor, wherein the control unit compares the target state quantity at the time of the process of stopping the target vacuum pump with the normal fluctuation range or the normal time fluctuation behavior, and changes a method of controlling the motor during the stop process depending on the comparison result.

8 Claims, 13 Drawing Sheets

(51) Int. Cl.

| | |
|---|---|
| ***F04C 15/00*** | (2006.01) |
| ***F04C 28/06*** | (2006.01) |
| ***F04C 25/02*** | (2006.01) |
| *F04C 2/02* | (2006.01) |

(52) U.S. Cl.
CPC ..... *F04C 25/02* (2013.01); *F04C 28/28* (2013.01); *F04C 2/025* (2013.01); *F04C 2220/10* (2013.01)

(58) Field of Classification Search
CPC ..... F04C 2270/02; F04C 2270/05; F04C 2270/0525; F04C 2270/185; F04C 2270/195; F04C 2280/02; F04C 25/02; F04C 2/025; F04D 17/168; F04D 27/001; F04D 19/042; F04D 19/048
See application file for complete search history.

(56) References Cited

U.S. PATENT DOCUMENTS

| | | | | |
|---|---|---|---|---|
| 10,753,363 | B2 * | 8/2020 | Kozaki | F04D 29/058 |
| 2005/0031468 | A1 * | 2/2005 | Kawaguchi | F04B 49/06 417/410.1 |
| 2007/0071610 | A1 | 3/2007 | Holzemer et al. | |
| 2008/0063534 | A1 * | 3/2008 | Nakayama | F04C 28/02 417/6 |
| 2008/0063536 | A1 * | 3/2008 | Koshizaka | F04C 28/06 417/32 |
| 2008/0109185 | A1 | 5/2008 | Cheung et al. | |
| 2008/0129237 | A1 * | 6/2008 | Atarashi | B60L 50/15 318/9 |
| 2009/0097984 | A1 | 4/2009 | Kido et al. | |
| 2009/0157016 | A1 * | 6/2009 | Adahan | A61M 1/90 604/290 |
| 2013/0071258 | A1 | 3/2013 | Enomoto | |
| 2014/0077746 | A1 * | 3/2014 | Sekiguchi | G05B 13/02 318/561 |
| 2014/0210385 | A1 * | 7/2014 | Kozaki | F04D 27/0261 318/400.02 |
| 2018/0347879 | A1 | 12/2018 | Tada et al. | |
| 2019/0149349 | A1 * | 5/2019 | Khalid | H04L 12/2818 455/420 |

FOREIGN PATENT DOCUMENTS

| | | | |
|---|---|---|---|
| EP | 1900943 | A1 | 3/2008 |
| EP | 2048365 | A2 | 4/2009 |
| JP | H10-073088 | A | 3/1998 |
| JP | 2005-009337 | A | 1/2005 |
| JP | 2008-524493 | A | 7/2008 |
| JP | 2009-097349 | A | 5/2009 |
| KR | 10-1835467 | B1 | 3/2018 |
| WO | WO 2006/064991 | A1 | 6/2006 |
| WO | WO 2011/145444 | A1 | 11/2011 |
| WO | WO 2017/042949 | A1 | 3/2017 |

* cited by examiner

FIG.9

| | | | | | | | |
|---|---|---|---|---|---|---|---|
| NUMBER TIMES OF ABNORMALITY GENERATION | 60 | 70 ↑ | | 140 | 70 | | |
| MOTOR-ON TIME [sec] | 100 | 100 | → | 200 | 200 | → | 150 |
| ABNORMALITY GENERATION FREQUENCY [1/sec] | 0.6 | 0.7 ↑ | | 0.7 | 0.35 ↓ | | |

CONTROL DEVICE, CONTROL SYSTEM, CONTROL METHOD, RECORDING MEDIUM AND MACHINE LEARNING DEVICE

CROSS-REFERENCE TO RELATED APPLICATIONS

This application claims the benefit of Japanese Priority Patent Application JP 2018-107889 filed on Jun. 5, 2018, the entire contents of which are incorporated herein by reference.

FIELD

This technique is related to control device, control system, control method, recording medium and machine learning device.

BACKGROUND AND SUMMARY

In semiconductor manufacturing devices, vacuum pumps are widely used for evacuating gases used in semiconductor manufacturing processes from the inside of the chamber for the purpose of creating a vacuum environment in the chamber. Displacement type vacuum pumps equipped with Roots type or screw type rotors are known as the vacuum pump.

Generally, a displacement type vacuum pump includes a pair of rotors disposed in a casing, and a motor that rotationally drives the rotor. A minute clearance is formed between the pair of rotors and between the rotors and the inner surface of the casing, and the rotor is configured to rotate in a non-contact manner with the casing. As the pair of rotors synchronously rotates in opposite directions, the gas in the casing is transferred from the suction side to the discharge side, and the gas is exhausted from a chamber or the like connected to the suction port.

Gas used for semiconductor manufacturing process, and a substance generated by a chemical reaction of the gas to be used may include some components that solidify or liquefy as the temperature decreases. Normally, the above-described vacuum pump generates compressive heat during the process of transferring gas, so that the vacuum pump in operation is at a high temperature to some extent. In high temperature by compression heat, in the case where the vacuum pump does not have the temperature at which the components in the gas and the product substance solidify or liquefy, the high temperature of the vacuum pump is maintained by external heating of the pump body or heating of the inflowing gas. Even when the gas including the above-mentioned components is exhausted using the vacuum pump, good vacuum evacuation is performed without solidifying or liquefying the components in the gas or the product substance.

However, in some semiconductor manufacturing processes, the liquefaction and solidification of the gas to be used or the product substance generated from the gas to be used cannot be prevented in the above-mentioned high temperature of the vacuum pump. When continuing the operation of the vacuum pump in this process, the solidified product (reaction product) accumulates in the gap between the pump rotors and between the pump rotor and the casing. Although there is a gap between the pump rotor and the casing at high temperature during pump operation, the gap may disappear due to the influence of the deposited product in low temperature of the pump after the pump is stopped. In the absence of the gap between the pump rotor and the casing, the pump cannot be activated, and the manufacturing process cannot be activated. Further, when the operation of the vacuum pump is stopped, and the temperature of the vacuum pump gradually decreases, the components included in the gas remaining in the casing may solidify, whereby this solidified product (reaction product) may accumulate in the gap between the rotors or between the rotor and the casing. As deposition of this product progresses, not only is the activation of the vacuum pump obstructed, but also the vacuum pump stops during the manufacturing process because an excessive load is applied to the vacuum pump during operation of the vacuum pump, resulting in significant damage to the manufacturing process.

JP 2009-97349 A discloses the operation control device for a vacuum pump having a rotor rotatably disposed in a casing wherein the operation control device includes a rotor control unit that controls the rotation of the rotor, and the rotor control unit has a function of stopping the rotor after rotating the rotor in the normal direction and/or the reverse direction along the predetermined timing pattern when the operation of the vacuum pump is stopped.

Even with the technique of JP 2009-97349 A, the solidified or liquefied product in the casing cannot be eliminated completely when the vacuum pump is stopped, and the vacuum pump cannot be activated normally in some cases. For that reason, when the operation of the vacuum pump is restarted from the state where the operation of the vacuum pump is once stopped, but the vacuum pump cannot be activated normally, the operation of the vacuum pump must be stopped again and the vacuum pump must be maintained or replaced. Therefore, the suspension period of the semiconductor manufacturing device is prolonged due to the re-stop of operation of the vacuum pump. In this way, as the semiconductor manufacturing device is suspended for a long period of time due to abnormality derived from the product of the vacuum pump, it is desired to reduce the generation frequency of maintenance or replacement of the vacuum pump. In addition, the exhaust system usually includes a plurality of vacuum pumps, and in this case, it is also desired to identify only the vacuum pump requiring maintenance with a higher probability before performing a reactivation. This is because when only the identified vacuum pump is maintained, and the operation is continued with a vacuum pump other than the identified vacuum pump, the possibility of continuing the operation is increased as a whole system without adversely affecting the entire exhaust system after the start of operation.

It is desirable to provide a control device, a control system, a control method, a recording medium, and a machine learning device that can reduce the generation frequency of maintenance or replacement of a vacuum pump.

A control device according to one embodiment, the control device that controls a target vacuum pump including a motor, the control device comprising: a decision unit that decides, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and a control unit that controls the motor, wherein the control unit compares the target state quantity at the time of the process of stopping the target vacuum pump with the normal fluctuation range or the normal time fluctuation behavior, and changes a method of controlling the motor during the stop process depending on the comparison result.

A control system according to one embodiment, the control system that controls a target vacuum pump including a motor, the control system comprising: a decision unit that decides, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and a control unit that controls the motor, wherein the control unit compares the target state quantity at the time of the process of stopping the target vacuum pump with the normal fluctuation range or the normal time fluctuation behavior, and changes a method of controlling the motor during the stop process depending on the comparison result.

A control method according to one embodiment, the control method of controlling a target vacuum pump including a motor, the control method comprising: determining, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and controlling the motor, wherein the controlling includes comparing the target state quantity at the time of the process of stopping the target vacuum pump with the normal fluctuation range or the normal time fluctuation behavior, and changing a method of controlling the motor during the stop process depending on the comparison result.

A non-transitory computer readable recording medium according to one embodiment, the non-transitory computer readable recording medium storing a program, the program causing a control device that controls a target vacuum pump including a motor to function as: a decision unit that decides, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and a control unit comparing the target state quantity at the time of the process of stopping the target vacuum pump with the normal fluctuation range or the normal time fluctuation behavior, and changes a method of controlling the motor during the stop process depending on the comparison result.

A machine learning device according to one aspect of this technique, the machine learning device for learning a method of controlling, in an exhaust system having a plurality of vacuum pumps, at least one motor of the vacuum pumps, the machine learning device comprising: a state measurement unit that measures a target state quantity which is a state quantity which fluctuates in accordance with a time of a process of stopping a vacuum pump in the vacuum pump under execution of a stop process; a storage unit that stores a pump stop control pattern of a target state quantity at a time of a process of stopping the target vacuum pump or another vacuum pump; and a processor, wherein the processor functions as a decision unit that decides, using at least one of target state quantity data at a past stop process of the target vacuum pump or another vacuum pump read from the storage unit, a normal fluctuation range or a normal time fluctuation behavior of the target state quantity at the time of the stop process, a learning unit that controls a motor of the target vacuum pump, compares the target state quantity at the time of the process of stopping the target vacuum pump with the normal fluctuation range or the normal time fluctuation behavior, updates the normal fluctuation range or the normal time fluctuation behavior of the target state quantity at the time of the stop process to store the updated data in the storage unit when it is determined that there is no deviation after determining presence or absence of a deviation from the normal fluctuation range of the target state quantity at the time of the process of stopping the target vacuum pump, and updates a method of controlling the motor at the time of the stop process in accordance with the deviation degree when it is determined that there is a deviation, and a reward calculation unit that calculates a reward for a result of updating a method of controlling the motor at the time of the stop process based on a measured target state quantity, wherein the target state quantity includes at least one of a driving current of a motor included in the at least one vacuum pump, electric power of the motor, a rotation number of a rotor, a temperature of the vacuum pump measured by a temperature sensor, a pressure in the vacuum pump measured by a pressure sensor, and a vibration frequency of the vacuum pump measured by a vibrometer, and wherein the learning unit learns a method of controlling at least one motor of the vacuum pump so that the reward is improved by repeating the update of the method of controlling the motor.

BRIEF DESCRIPTION OF DRAWINGS

FIG. 9 is a diagram showing an example of changing the ON period of a motor 33 during the stop process;

DETAILED DESCRIPTION

Figure 1:
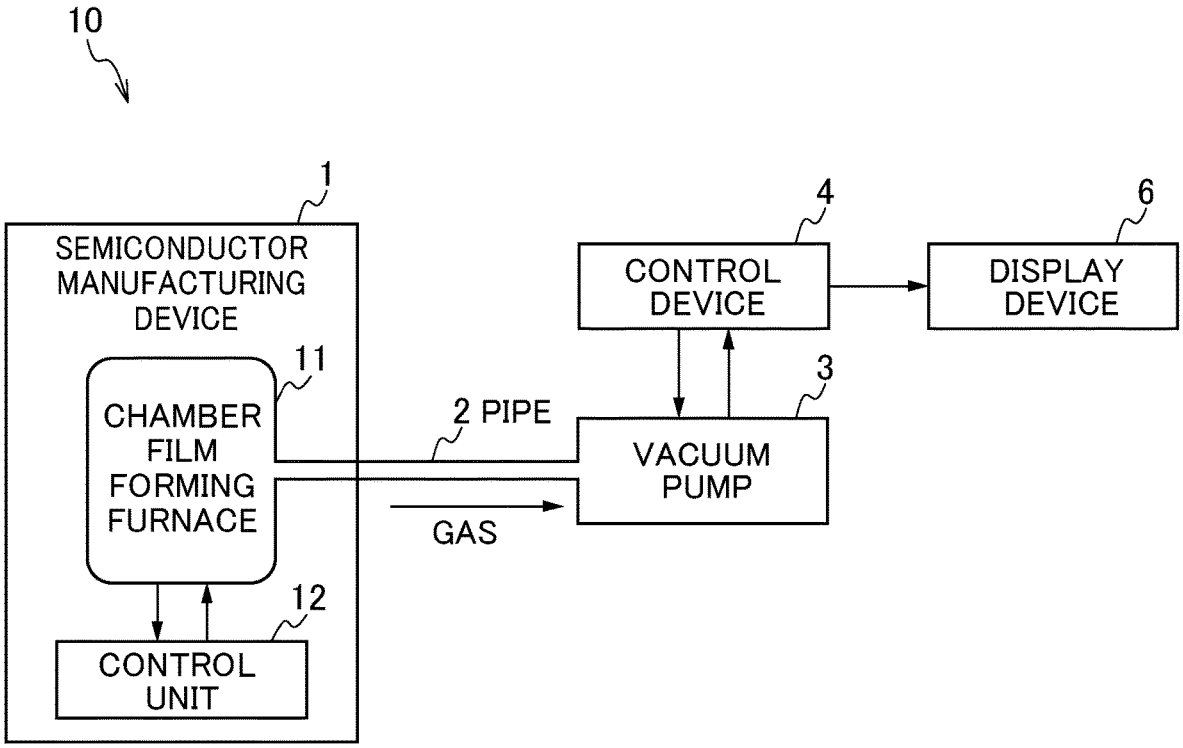
FIG. 1 is a schematic configuration diagram of a semiconductor manufacturing system 10 according to the present embodiment.

Hereinafter, each embodiment will be described with reference to the drawings. However, detailed explanation more than necessary may be omitted. For example, detailed explanations of already well-known matters and redundant explanation on substantially the same configuration may be omitted. This is to avoid the unnecessary redundancy of the following description and to facilitate understanding by those skilled in the art. The entire contents of U.S. Pat. Nos. 8,172,544 and 9,956,524 are incorporated herein by reference.

A control device according to a 1st aspect of one embodiment, the control device that controls a target vacuum pump including a motor, the control device comprising: a decision unit that decides, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and a control unit that controls the motor, wherein the control unit compares the target state quantity at the time of the process of stopping the target vacuum pump with the normal fluctuation range or the normal time fluctuation behavior, and changes a method of controlling the motor during the stop process depending on the comparison result.

In accordance with this configuration, the method of controlling the motor during the stop process is changed, and the reaction product deposited in the gap between the rotors or between the rotor and the casing can be dropped. In this way, since the probability of reactivating the vacuum pump can be increased, it is possible to reduce the generation frequency of maintenance or replacement of the vacuum pump. As a result, the cost for maintenance or replacement of the vacuum pump can be reduced.

A control device according to a 2nd aspect of one embodiment, the control device according to the 1st aspect, wherein the control unit changes the method of controlling the motor during the stop process in accordance with a degree of separation from the normal fluctuation range as the comparison result with respect to the target state quantity at the time of the process of stopping the target vacuum pump.

In accordance with this configuration, the reaction product deposited in the gap between the rotors or between the rotor and the casing can be dropped by changing the method of controlling the motor during the stop process in accordance with the degree of separation from the normal fluctuation range. In this way, since the probability of reactivating the vacuum pump can be increased, it is possible to reduce the generation frequency of maintenance or replacement of the vacuum pump.

A control device according to a 3rd aspect of one embodiment, the control device according to the 1st or 2nd aspect, wherein the control unit changes the method of controlling the motor during the stop process in accordance with an amount of change in a degree of separation from the normal fluctuation range as the comparison result, with respect to the target state quantity at the time of the process of stopping the target vacuum pump.

In accordance with this configuration, the reaction product deposited in the gap between the rotors or between the rotor and the casing can be dropped by changing the method of controlling the motor during the stop process in accordance with the amount of change in the degree of separation from the normal fluctuation range. In this way, since the probability of reactivating the vacuum pump can be increased, it is possible to reduce the generation frequency of maintenance or replacement of the vacuum pump.

A control device according to a 4th aspect of one embodiment, the control device according to any one of the 1st to 3rd aspect, wherein the control unit changes the method of controlling the motor during the stop process in accordance with the number of times or a frequency of a deviation from the normal fluctuation range as the comparison result with respect to the target state quantity at the time of the process of stopping the target vacuum pump.

In accordance with this configuration, the reaction product deposited in the gap between the rotors or between the rotor and the casing can be dropped by changing the method of controlling the motor during the stop process in accordance with the number of times or frequency of a deviation from the normal fluctuation range. In this way, since the probability of reactivating the vacuum pump can be increased, it is possible to reduce the generation frequency of maintenance or replacement of the vacuum pump.

A control device according to a 5th aspect of one embodiment, the control device according to any one of the 1st to 4th aspect, wherein the control unit changes the method of controlling the motor during the stop process in accordance with a change in a frequency of a deviation from the normal fluctuation range as the comparison result with respect to the target state quantity at the time of the process of slopping the target vacuum pump.

In accordance with this configuration, the reaction product deposited in the gap between the rotors or between the rotor and the casing can be dropped by changing the method of controlling the motor during the stop process in accordance with the change in the frequency of a deviation from the normal fluctuation range. In this way, since the probability of reactivating the vacuum pump can be increased, it is possible to reduce the generation frequency of maintenance or replacement of the vacuum pump.

A control device according to a 6th aspect of one embodiment, the control device according to any one of the 1st to 5th aspect, wherein changing the method of controlling the motor during the stop process includes changing an output of the motor during the stop process.

In accordance with this configuration, when the target state quantity at the time of the process of stopping the target vacuum pump is abnormal as compared with the normal fluctuation range or the normal time fluctuation behavior, the reaction product deposited in the gap between the rotors or between the rotor and the casing can be dropped by changing the output of the motor during the stop process. In this way, since the probability of reactivating the vacuum pump can be increased, it is possible to reduce the generation frequency of maintenance or replacement of the vacuum pump.

A control device according to a 7th aspect of one embodiment, the control device according to any one of the 1st to 5th aspect, wherein changing the method of controlling the motor during the stop process includes changing an ON period and/or an OFF period of the motor during the step process.

In this way, when the target state quantity at the time of the process of stopping the target vacuum pump is abnormal as compared with the normal fluctuation range or the normal time fluctuation behavior, the reaction product deposited in the gap between the rotors or between the rotor and the casing can be dropped by changing the of ON and/or OFF period of the motor during the stop process. In this way, since the probability of reactivating the vacuum pump can be increased, it is possible to reduce the generation frequency of maintenance or replacement, of the vacuum pump.

A control device according to a 8th aspect of one embodiment, the control device according to any one of the 1st to 5th aspect, wherein changing the method of controlling the motor during the stop process includes changing a rotation direction of the motor during the stop process.

In accordance with this configuration, when the target state quantity at the time of the process of stopping the target vacuum pump is abnormal as compared with the normal fluctuation range or the normal time fluctuation behavior, the reaction product deposited in the gap between the rotors or between the rotor and the casing can be dropped by changing the direction of rotation of the motor during the stop process. In this way, since the probability of reactivating the vacuum pump can be increased, it is possible to reduce the generation frequency of maintenance or replacement of the vacuum pump.

A control device according to a 9th aspect of one embodiment, the control device according to any one of the 1st to 8th aspect, further comprising a determination unit determining whether reactivation after an operation of the vacuum pump is stopped is possible by comparing the target state quantity at the time of the stop process of the target vacuum pump with the normal fluctuation range or the normal time fluctuation behavior.

In accordance with this configuration, since the user of the vacuum pump 3 can determine whether reactivation after the operation of the vacuum pump 3 is stopped is possible before the reactivation is started, the probability of stopping again after the reactivation is started is reduced. In this way, it is possible to suppress the occurrence of a situation in which the suspension period of the semiconductor manufacturing device is prolonged due to abnormality derived from the product of the vacuum pump.

A control system according to a 10th aspect of one embodiment, the control system that controls a target vacuum pump including a motor, the control system comprising: a decision unit that decides, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and a control unit that controls the motor, wherein the control unit compares the target state quantity at the time of the process of stopping the target vacuum pump with the normal fluctuation range or the normal time fluctuation behavior, and changes a method of controlling the motor during the stop process depending on the comparison result.

In accordance with this configuration, the method of controlling the motor during the stop process is changed, and the reaction product deposited in the gap between the rotors or between the rotor and the casing can be dropped. In this way, since the probability of reactivating the vacuum pump can be increased, it is possible to reduce the generation frequency of maintenance or replacement of the vacuum pump. As a result, the cost for maintenance or replacement of the vacuum pump can be reduced.

A control method according to an 11th aspect of one embodiment, the control method of controlling a target vacuum pump including a motor, the control method comprising: determining, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and controlling the motor, wherein the controlling includes comparing the target state quantity at the time of the process of stopping the target vacuum pump with the normal fluctuation range or the normal time fluctuation behavior, and changing a method of controlling the motor during the stop process depending on the comparison result.

In accordance with this configuration, the method of controlling the motor during the stop process is changed, and the reaction product deposited in the gap between the rotors or between the rotor and the casing can be dropped. In this way, since the probability of reactivating the vacuum pump can be increased, it is possible to reduce the generation frequency of maintenance or replacement of the vacuum pump. As a result, the cost for maintenance or replacement of the vacuum pump can be reduced.

A non-transitory computer readable recording medium according to a 12th aspect of one embodiment, the non-transitory computer readable recording medium storing a program, the program causing a control device that controls a target vacuum pump including a motor to function as: a decision unit that decides, using at least one of target state quantities at a time of a past stop process of the target vacuum pump or another vacuum pump wherein the target state quantities are state quantities which fluctuate in accordance with a load at a time of a process of stopping a vacuum pump, a normal fluctuation range or a normal time fluctuation behavior of the target state quantity at the time of the stop process; and a control unit comparing the target state quantity at the time of the process of stopping the target vacuum pump with the normal fluctuation range or the normal time fluctuation behavior, and changes a method of controlling the motor during the stop process depending on the comparison result.

In accordance with this configuration, the method of controlling the motor during the stop process is changed, and the reaction product deposited in the gap between the rotors or between the rotor and the casing can be dropped. In this way, since the probability of reactivating the vacuum pump can be increased, it is possible to reduce the generation frequency of maintenance or replacement of the vacuum pump. As a result, the cost for maintenance or replacement of the vacuum pump can be reduced.

A machine learning device according to a 13th aspect of one embodiment, the machine learning device for learning a method of controlling, in an exhaust system having a plurality of vacuum pumps, at least one motor of the vacuum pumps, the machine learning device comprising: a state measurement unit that measures a target state quantity which is a state quantity which fluctuates in accordance with a time of a process of stopping a vacuum pump in the vacuum pump under execution of a stop process; a storage unit that stores a pump stop control pattern of a target state quantity at a time of a process of stopping the target vacuum pump or another vacuum pump; and a processor, wherein the processor functions as a decision unit that decides, using at least one of target state quantity data at a past stop process of the target vacuum pump or another vacuum pump read from the storage unit, a normal fluctuation range or a normal time fluctuation behavior of the target state quantity at the time of the stop process, a learning unit that controls a motor of the target vacuum pump, compares the target state quantity at the time of the process of stopping the target vacuum pump with the normal fluctuation range or the normal time fluctuation behavior, updates the normal fluctuation range or the normal time fluctuation behavior of the target state quantity at the time of the stop process to store the updated data in the storage unit when it is determined that there is no deviation after determining presence or absence of a deviation from the normal fluctuation range of the target state quantity at the time of the process of stopping the target vacuum pump, and updates a method of controlling the motor at the time of the stop process in accordance with the deviation degree when it is determined that there is a deviation, and a reward calculation unit that calculates a reward for a result of updating a method of controlling the motor at the time of the stop process based on a measured target state quantity, wherein the target state quantity includes at least one of a driving current of a motor included in the at least one vacuum pump, electric power of the motor, a rotation number of a rotor, a temperature of the vacuum pump measured by a temperature sensor, a pressure in the vacuum pump measured by a pressure sensor, and a vibration frequency of the vacuum pump measured by a vibrometer, and wherein the learning unit learns a method of controlling at least one motor of the vacuum pump so that the reward is improved by repeating the update of the method of controlling the motor.

In accordance with this configuration, since the reactivation probability is improved by automatically learning the method of controlling the motor, algorithm development time and cost can be reduced.

It is conceivable to change the method of controlling the motor of the vacuum pump during the step process by using the state quantity at the time of the process of stopping the vacuum pump in order to reduce the generation frequency of maintenance or replacement of the vacuum pump. In this case, there is a new problem that it is difficult to distinguish the fluctuation (normal fluctuation) in which the pump can be reactivated, the fluctuation in the state quantity (abnormal fluctuation) that cannot be reactivated, and the fluctuation of state quantity (normal fluctuation) due to other factors from the fluctuation of the state quantity derived from the solidified or liquefied product in the vacuum pump at the time of the process of stopping the vacuum pump.

In response to this problem, the control device according to the present embodiment decides, using at least one of target state quantities at the time of the past stop process of the target vacuum pump or another vacuum pump wherein the target state quantities are state quantities that fluctuate in accordance with the time of the process of stopping the vacuum pump, the normal fluctuation range or the normal time fluctuation behavior of the target state quantity at the time of the stop process. The control device according to the present embodiment compares the target state quantity at the time of the process of stopping the target vacuum pump with the normal fluctuation range or the normal time fluctuation behavior of the target state quantity at the time of the stop process. The control device changes the method of controlling the motor during the stop process in accordance with the comparison result.

FIG. 1 is a schematic configuration diagram of a semiconductor manufacturing system 10 according to the present embodiment. As shown in FIG. 1, the semiconductor manufacturing system 10 according to the present embodiment includes a semiconductor manufacturing device 1, a vacuum pump 3, a pipe 2 connecting the semiconductor manufacturing device 1 and the vacuum pump 3, a control device 4 connected to the vacuum pump 3, and a display device 6 connected to the control device 4. The semiconductor manufacturing device 1 includes a chamber film forming furnace 11, and a control unit 12 that controls the chamber film forming furnace 11. The chamber film forming furnace 11 and the vacuum pump 3 communicate with each other via the pipe 2, and the gas in the chamber film forming furnace 11 is discharged and is substantially sucked in vacuum by operating the vacuum pump 3. The control device 4 controls the operation of the vacuum pump 3. The control device 4 causes the display device 6 to display information (for example, a determination result as to whether reactivation after the operation of the vacuum pump is stopped is possible).

Figure 2:
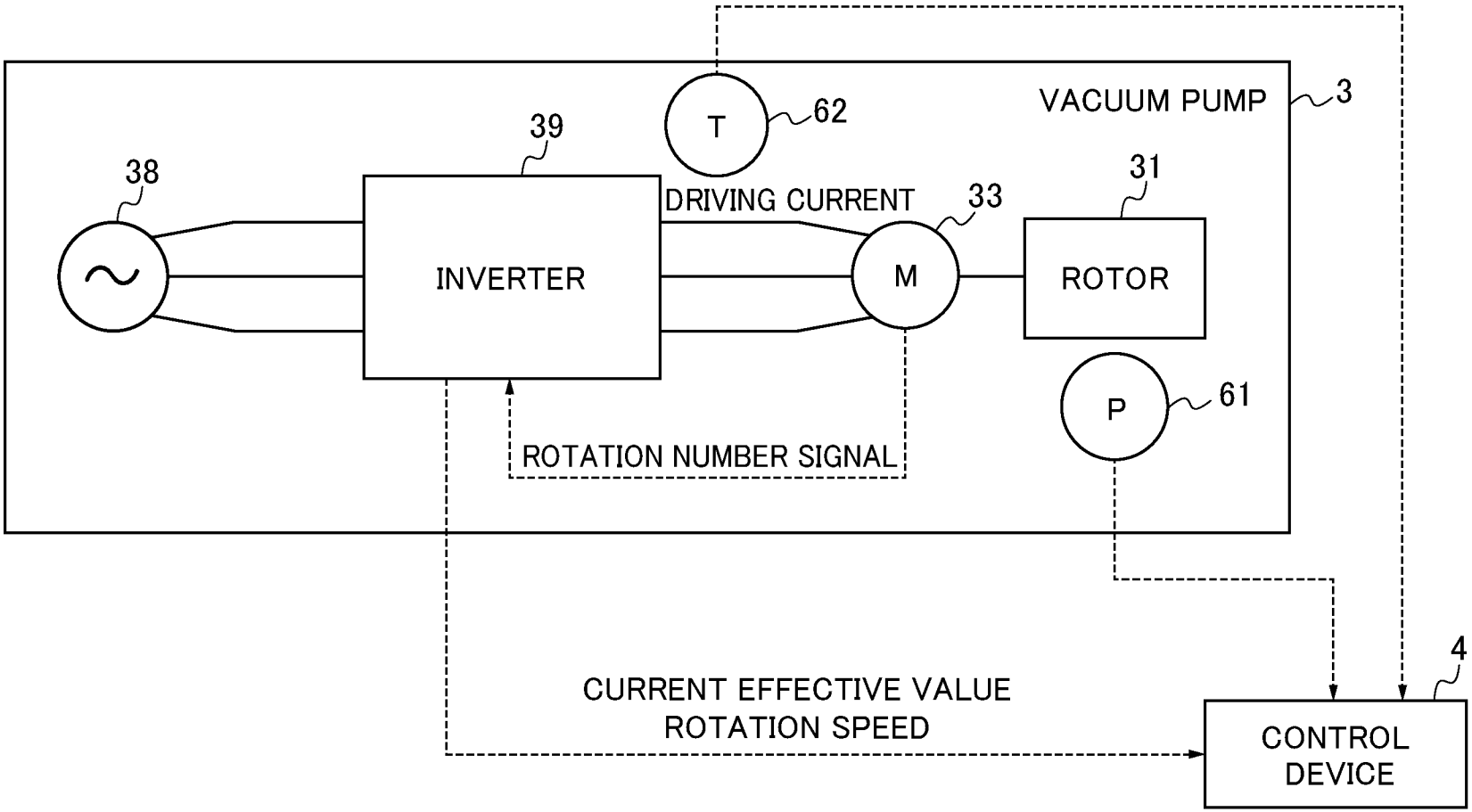
FIG. 2 is a schematic functional configuration diagram of a vacuum pump 3 according to the present embodiment.

FIG. 2 is a schematic functional configuration diagram of the vacuum pump 3 according to the present embodiment. As shown in FIG. 2, the vacuum pump 3 includes a power supply 38, an inverter 39 whose input is connected to the power supply 38, a motor 33 whose input is connected to the output of the inverter 39, and a rotor 31 connected to the rotation shaft of the motor 33. Further, the vacuum pump 3 includes a pressure gauge 61 and a thermometer 62.

As shown in FIG. 2, a rotation number signal indicating the rotation number of the motor 33 is supplied from the motor 33 to the inverter 39. The current effective value of the driving current and the rotation speed of the motor 33 obtained from the rotation number signal are supplied from the inverter 39 to the control device 4. In addition, a pressure signal indicating the pressure value in the vacuum pump 3 measured by the pressure gauge 61 is supplied to the control device 4. In addition, a temperature signal indicating the temperature measured by the thermometer 62 is supplied to the control device 4.

In addition, a vibration sensor that detects the vibration of the vacuum pump 3, a displacement sensor that detects the displacement of the vacuum pump 3, and an acceleration sensor that detects the acceleration of the vacuum pump 3 are installed, and output values of the respective sensors may be supplied to the control device 4.

The inverter 39 frequency-converts the alternating current supplied from the power supply 38, and supplies the driving current obtained by the frequency conversion to the motor 33. In this way, the rotation shaft of the motor 33 is rotated by the driving current, and as the rotor 31 rotates accordingly, the gas sucked from the pipe 2 is discharged to the outside of the vacuum pump 3 as the rotor 31 rotates.

In the vacuum pump 3 having the above configuration, the gas sucked from the suction port (not shown) is transferred to the exhaust side in accordance with the rotors 31, and is exhausted from the exhaust port not shown) by driving the motor 33 to rotate a pair of rotors 31. As the gas is continuously transferred from the suction side to the exhaust side, the gas in the chamber film forming furnace 11 connected to the suction port is evacuated.

The rotor 31 of the vacuum pump according to the present embodiment is, for example, a Roots type. The vacuum pump 3 may be provided with a screw rotor. Further, the vacuum pump 3 may be a claw or scroll vacuum pump. Further, although the vacuum pump 3 according to the present embodiment is a multi-stage pump as an example, the present invention is not limited to this, and a single stage pump may be used.

When the control device 4 stops the operation of the target vacuum pump 3, the control device 4 controls the rotation of the rotor so as to perform the stop process. Here, the stop process is a process of stopping the rotor 31 after rotating the rotor 31 in the normal direction and/or the reverse direction after starting the pump stop.

Figure 3:
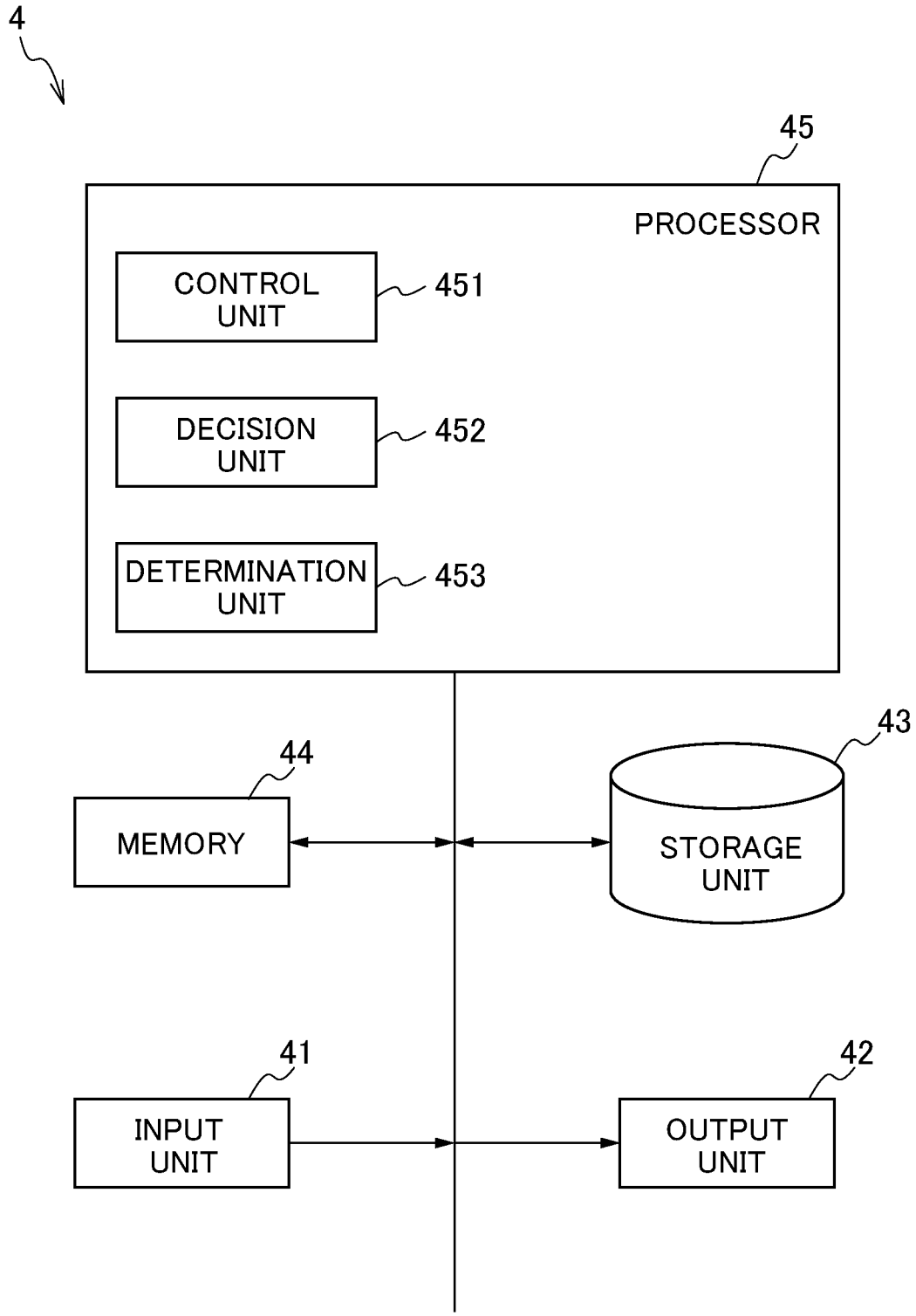
FIG. 3 is a block diagram showing a schematic configuration of a control device 4 according to the present embodiment.

FIG. 3 is a block diagram showing a schematic configuration of the control device 4 according to the present embodiment. As shown in FIG. 3, the control device 4 includes an input unit 41, an output unit 42, a storage unit 43, a memory 44, and a processor 45.

The input unit 41 is connected to the inverter 39 and the pressure gauge 61, and the current effective value of the driving current, the rotation speed of the motor 33, and the pressure value in the vacuum pump 3 are input to the input unit 41. The output unit 42 outputs information in accordance with a command from the processor 45. A program to be executed by the processor 45 is stored in the storage unit 43. The memory 44 temporarily stores information. The processor 45 reads out and executes the program stored in the storage unit 43. In this way, a CPU (Central Processing Unit) 55 functions as a control unit 451 that controls the motor 33, a decision unit 452, and a determination unit 453.

Figure 4:
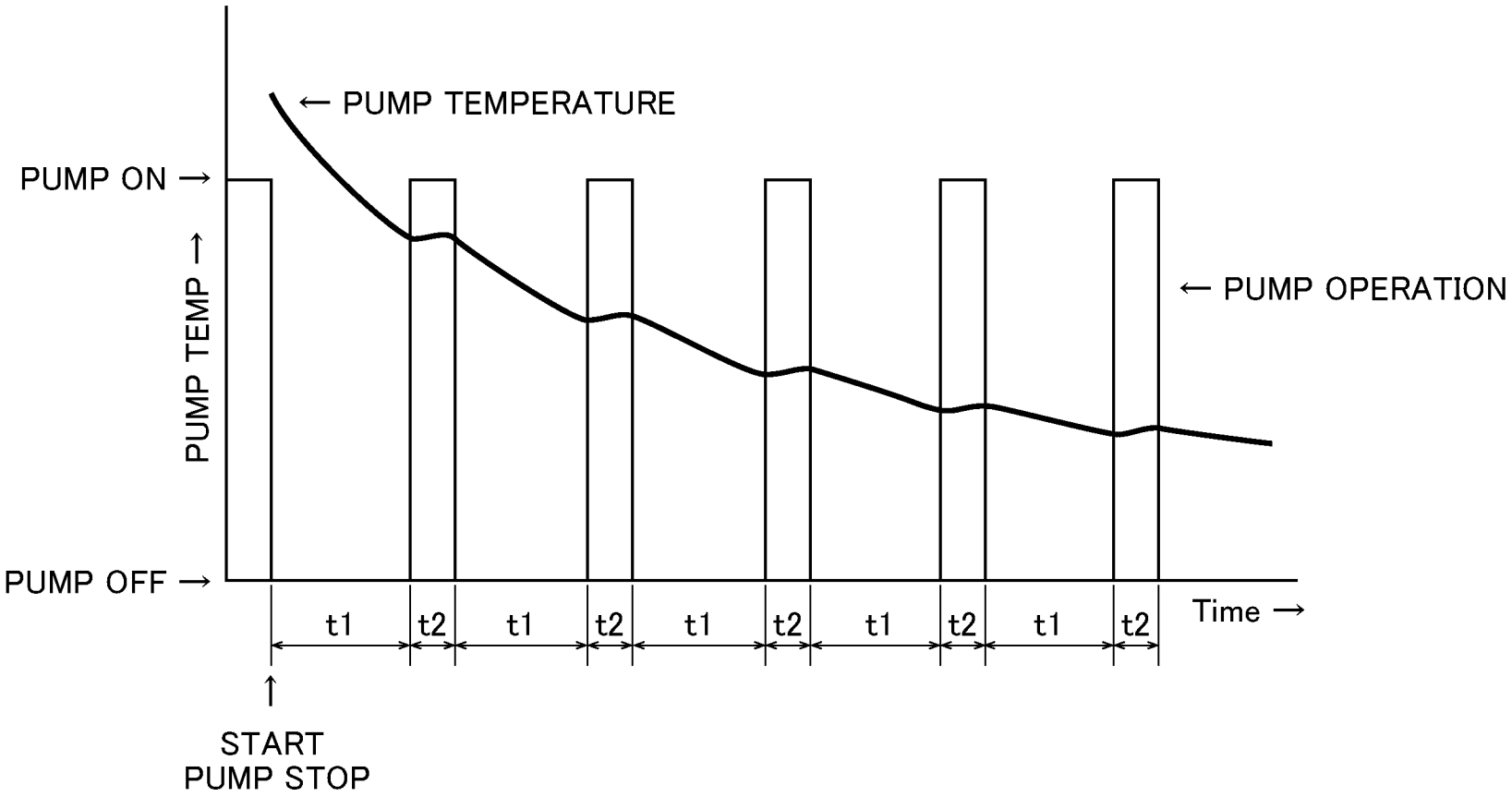
FIG. 4 is a diagram showing a first example of a pump stop control pattern by a control device.

FIG. 4 is a diagram showing a first example of the pump stop control pattern by the control device. As shown in FIG. 4, in the first example of FIG. 4, the rotation of the rotor 31 in the normal direction and/or the reverse direction is performed along a predetermined timing pattern in the stop process.

For example, the storage unit 43 of the control device 4, as shown in FIG. 3, stores a pump stop control pattern (timing pattern for controlling the pump stop) for turning ON and OFF the vacuum pump with the lapse of time when an operation stop switch (not shown) is operated by the operator and operation stop of the vacuum pump is started.

When a stop start signal is generated in the vacuum pump, using a timer (not shown) built in the control unit 451, ON/OFF of the vacuum pump according to the stop pattern of FIG. 4 is performed, that is, a pump stop control pattern is performed to repeat the operation of turning OFF the vacuum pump for the time t1 and turning ON the vacuum pump for the time t2 so that the pump is turned OFF until the time t1 has elapsed from the start of the pump stop, and the pump is turned ON until the time t2 elapses after the elapse of the time t1. As a result, the rotor 31 is rotated and stopped. In the present embodiment, a pattern of the timer is set so that the rotor 31 is driven in the order of normal rotation (rotation in the normal direction), stop, and normal rotation.

When the rotors 31 rotate in the normal direction, one of the rotors 31 rotates in a certain direction (for example, clockwise) and the other rotate rotates in the opposite direction (for example, counterclockwise). In this case, the gas is sucked into the casing from the suction port and transferred to the exhaust port, and then, it is discharged from the exhaust port. That is, the rotation in the normal direction of the rotor 31 means the rotation of the rotor 31 in such a direction that the gas in the casing 32 is transferred from the suction port toward the exhaust port.

As described above, when the vacuum pump 3 is stopped, the vacuum pump 3 is once operated after stopping the rotor 31, and the rotor 31 is rotated again so that the force of the rotor 31 can be applied to the product deposited for example, between the rotor 31 and the casing 32 when the temperature of the vacuum pump lowers. As a result, it is possible to prevent the product from biting due to shrinkage, and since the product is removed, it is possible to smoothly start up the vacuum pump 3. It is possible to more reliably remove the product by setting a pattern that repeats the rotating and stopping motions of the rotor 31 several times. After the vacuum pump starts normally, the rotor 31 rotates in the normal direction in the steady state, and the gas is exhausted.

Figure 5:
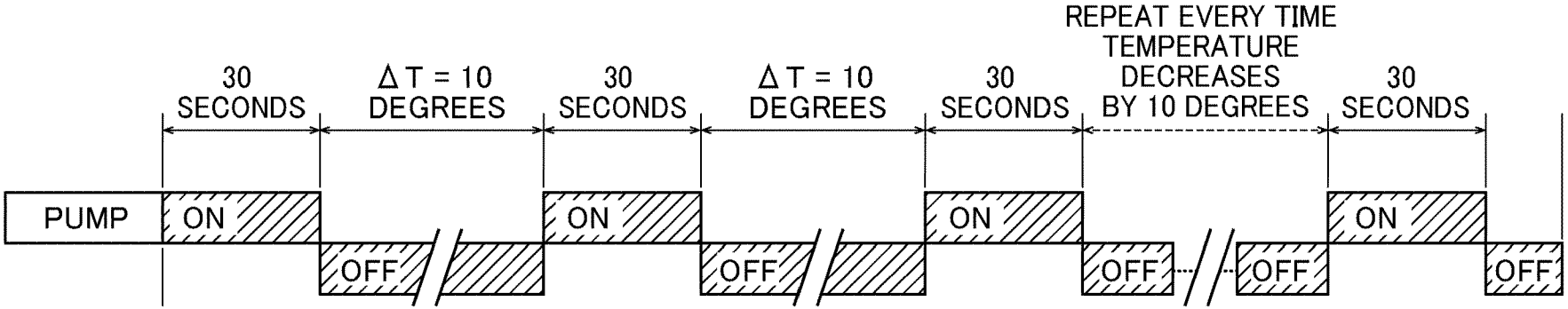
FIG. 5 is a diagram showing a second example of a pump stop control pattern by a control device.

FIG. 5 is a diagram showing a second example of the pump stop control pattern by the control device. As shown in FIG. 5, in the second example of FIG. 5, the stop process includes stopping the vacuum pump 3 until the temperature of the vacuum pump 3 drops by a predetermined temperature, and thereafter operating the vacuum pump. As shown in FIG. 5, after the initial stop of the vacuum pump 3, the vacuum pump 3 is activated (ON) for a prescribed time (30 seconds in this example) thereby promoting the removal of product in the vacuum pump 3. Subsequently, the vacuum pump 3 is stopped (turned OFF) until the temperature measured by the thermometer 62 (that is, the temperature in the vacuum pump 3) decreases by a predetermined temperature ΔT (here, 10 degrees, for example). Thereafter, when the temperature inside the vacuum pump 3 measured by the thermometer 62 drops by 10 degrees, the vacuum pump 3 is turned ON again for a prescribed time (30 seconds in this example), and then stops (OFF) again until the temperature measured by the thermometer 62 further decreases by 10 degrees. This cycle is repeated until either the temperature measured by the thermometer 62 reaches a prescribed temperature or the time elapsed from the start of the sequence reaches a prescribed time.

Figure 6:
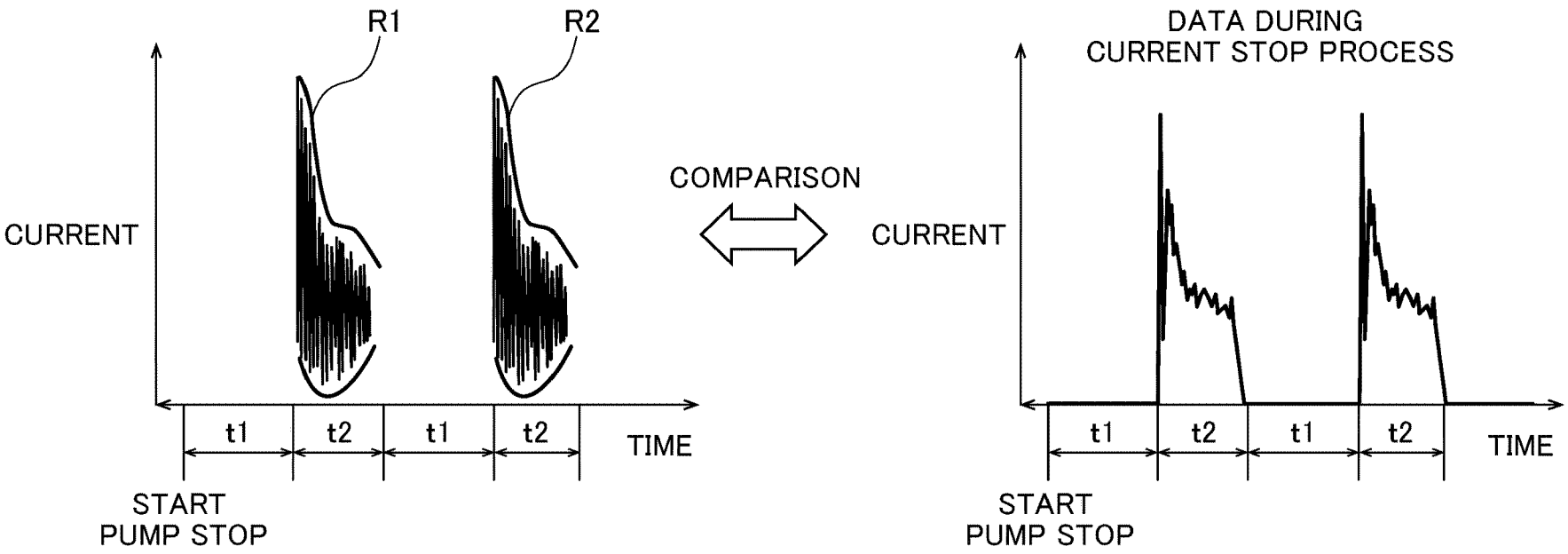
FIG. 6 is a schematic diagram in which a normal fluctuation range and current data in a stop process are compared.

FIG. 6 is a schematic diagram comparing the normal fluctuation range with the current data in the stop process. As described with reference to FIG. 4, in the stop process, the operation of turning OFF the vacuum pump for the time t1 and turning ON the vacuum pump for the time t2 is repeated. The normal fluctuation ranges R1 and R2 of the current effective value of the driving current of the motor 33 for the time t2 during which the vacuum pump is turned ON are shown in the graph on the left side of FIG. 6. On the other hand, temporal change of the current effective value of the driving current of the motor 33 during the current stop process is shown in the graph on the right side of FIG. 6. When the temporal change in the current effective value for the time t2 during which the vacuum pump is turned ON during the current stop process is within the normal fluctuation ranges R1 and R2, it can be determined that the temporal change is normal.

As an example, the decision unit 452 according to the present embodiment decides, using at least one of target state quantities at the time of the past stop process of the target vacuum pump 3 wherein the target state quantities (for example, the current effective value of the driving current) are state quantities that fluctuate in accordance with the load at she time of stopping the vacuum pump 3, the normal fluctuation range or the normal time fluctuation behavior of the target state quantity at the time of the stop process. Here, the state quantity is the state quantity of the vacuum pump 3, the target state quantity includes, for example, the driving current of the motor included in the vacuum pump, the electric power of the motor, the rotation number of the rotor, the temperature of the vacuum pump, the pressure in the vacuum pump, the vibration frequency of the vacuum pump, and these measured values are used.

After the target vacuum pump 3 is activated, the decision unit 452 decides, based on the target state quantity at the time of the stop process for the prescribed number of times (for example, 10 times), the normal fluctuation range or the normal time fluctuation behavior of the target state quantity at the time of the stop process.

The control unit 451 compares the target state quantity at the time of the process of stopping the target vacuum pump with the normal fluctuation range or the normal time fluctuation behavior, and changes the method of controlling the motor 33 during the stop process depending on the comparison result. In the present embodiment, as an example, the normal fluctuation range is a fluctuation range of the temporal change of the target state quantity at the time of the normal state in the stop process, and as shown in FIG. 6, the control unit 451 compares the temporal change of the target state quantity at the time of the stop process of the target vacuum pump 3, with the fluctuation range of the temporal change of the target state quantity at the time of the normal state in the stop process.

The determination unit 453 compares the target state quantity at the time of the stop process of the target vacuum pump 3 with the normal fluctuation range or the normal time fluctuation behavior, thereby determining whether reactivation after the operation of the vacuum pump 3 is stopped is possible. In the present embodiment, as an example, as shown in FIG. 6, the determination unit 453 compares the temporal change of the target state quantity at the time of the stop process of the target vacuum pump 3, with the fluctuation range of the temporal change of the target state quantity at the time of the normal state in the stop process.

In the example of FIG. 6, for example, the determination unit 453 compares the normal fluctuation range R1 of FIG. 6 with the temporal change of the current effective value of the driving current at the time of the stop process. In a case where the temporal change of the current effective value of the driving current at the current stop process falls within this normal fluctuation range R1, it is determined that reactivation after the operation of the vacuum pump 3 is stopped is possible, and in a case where the temporal change of the current effective value of the driving current at the current stop process does not fail within this normal fluctuation range R1, it is determined that reactivation after the operation of het vacuum pump 3 is stopped is not possible.

In accordance with this configuration, it is possible to improve the accuracy of determining whether reactivation after the operation of the vacuum pump 3 is stopped is possible by comparing the temporal change of the target state quantity at time of the process of stopping the target vacuum pump with the fluctuation range of the temporal change of the target state quantity at the time of the normal state in the stop process.

On this occasion, for example, when the target state quantity at the time of the stop process deviates from the normal fluctuation range or the normal time fluctuation behavior, the determination unit 453 may output, to the display device 6, a determination result indicating that reactivation after the operation of the vacuum pump 3 is stopped is not possible. For this reason, since the user of the vacuum pump 3 can determine whether reactivation after the operation of the vacuum pump 3 is stopped is possible before the reactivation is started, the probability of stopping again after the reactivation is started is reduced. In this way, it is possible to suppress the occurrence of a situation in which the suspension period of the semiconductor manufacturing device is prolonged due to abnormality derived from the product of the vacuum pump.

Figure 7:
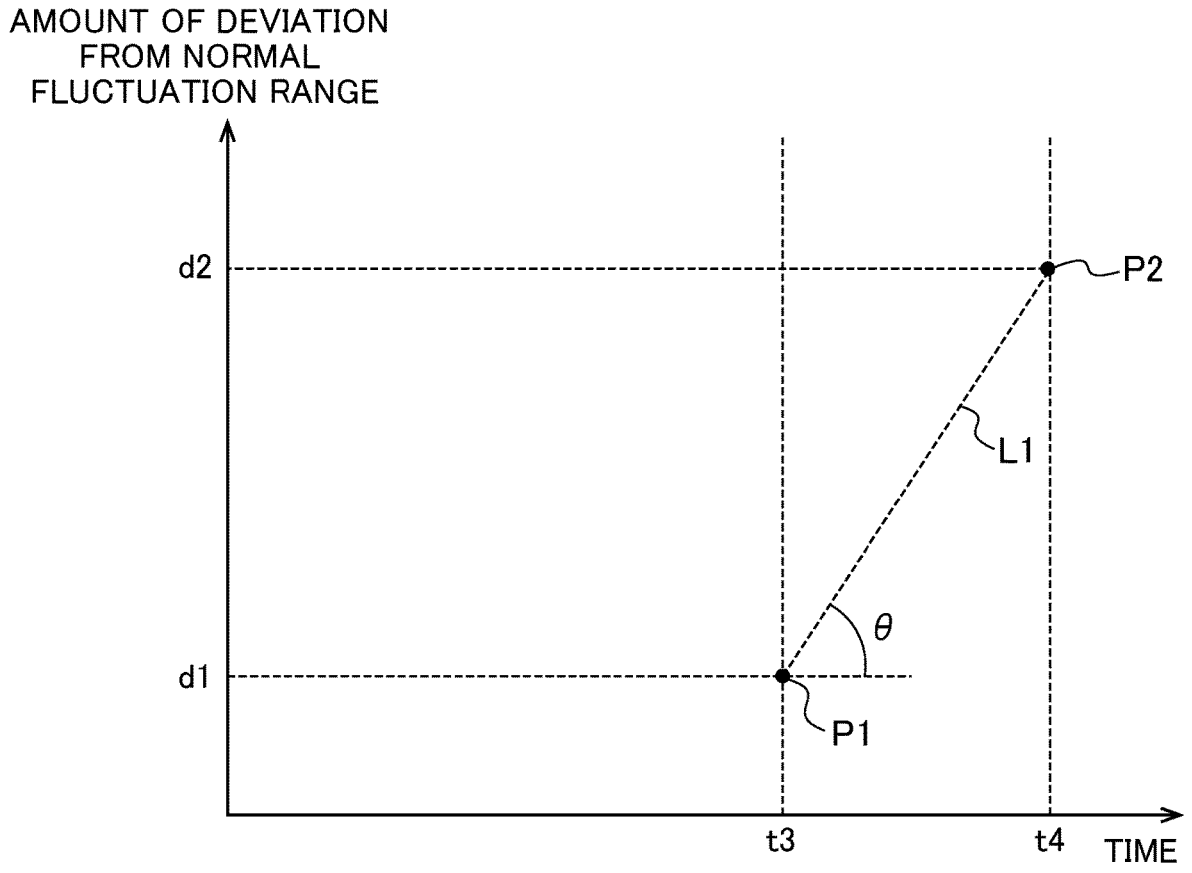
FIG. 7 is a schematic diagram showing a temporal change in an amount deviating from a normal fluctuation range.

FIG. 7 is a schematic diagram showing a temporal change of an amount deviating from the normal fluctuation range. In FIG. 7, the amount of a deviation from the normal fluctuation range at time t3 is d1, and the amount of a deviation from the normal fluctuation range at time t4 is d2.

For example, when the inclination θ of the line segment L1 from the point P1 to the point P2 exceeds the threshold angle, the control unit 451 may change the method of controlling the motor 33 during the stop process (for example, the motor output may be increased). Alternatively, when (d2−d1) exceeds the threshold change amount, the control unit 451 may change the method of controlling the motor 33 daring the stop process (for example, the motor output may be increased). Alternatively, when the amount of change (d2−d1)/(t4−t3) of the amount of a deviation from the normal fluctuation range per unit time exceeds the threshold change rate, the control unit 451 may change the method of controlling the motor 33 during the stop process (for example, the motor output may be increased).

In this way, the control unit 451 may change the method of controlling the motor during the stop process in accordance with the amount of change in the degree of separation from the normal fluctuation range with respect to the target state quantity at the time of the process of stopping the target vacuum pump.

Figure 8:
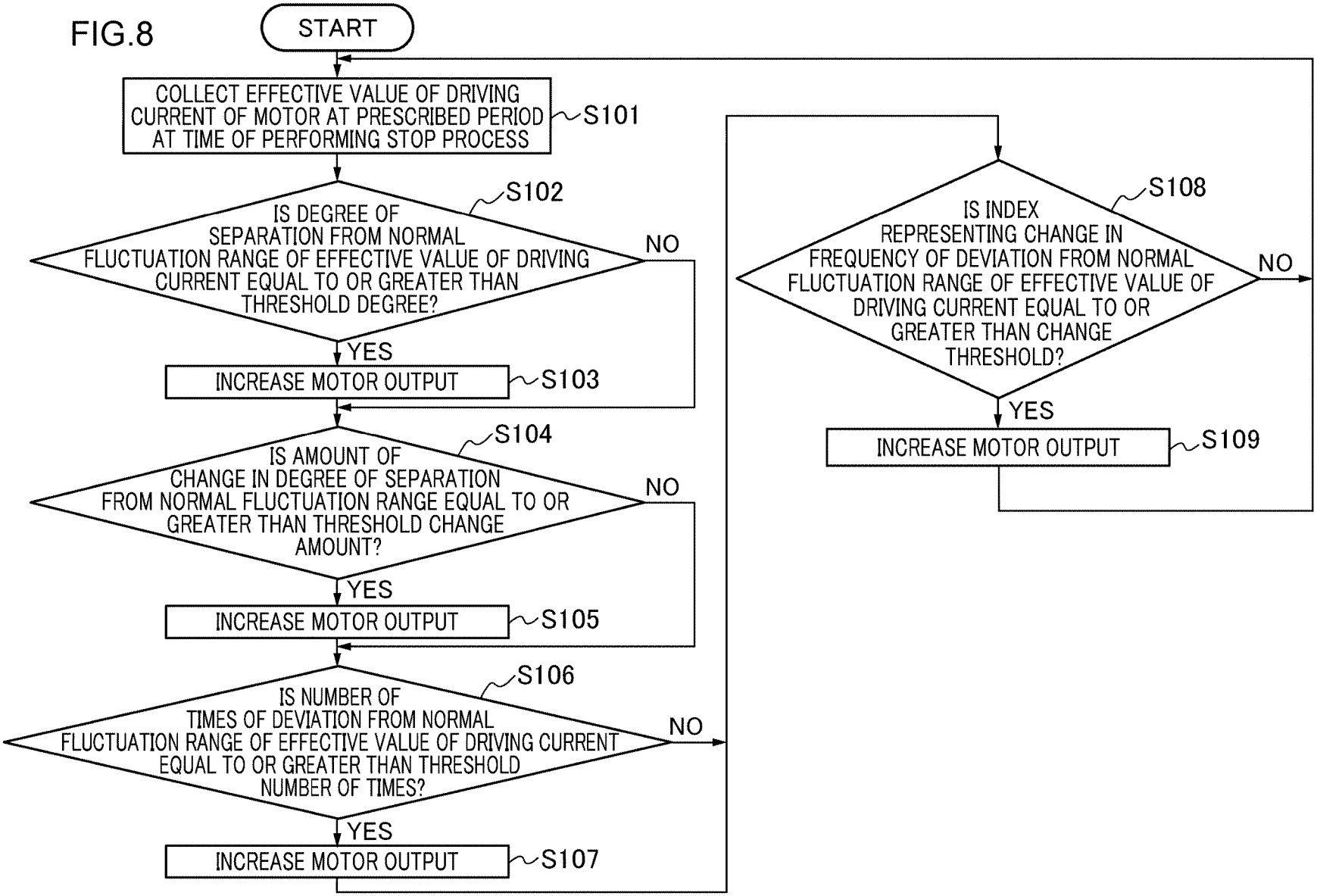
FIG. 8 is a flowchart showing an example of control of a motor during a stop process.

FIG. 8 is a flowchart showing an example of control of the motor during the stop process.

(Step S101) First, the processor 45 of the control device 4 collects the effective value of the driving current of the motor 33 at the prescribed period at the time of performing the stop process.

(Step S102) Next, the control unit 451 determines whether the degree of separation from the normal fluctuation range of the effective value of the driving current is equal to or greater than the threshold degree. When the degree of separation from the normal fluctuation range of the effective value of the driving current is less than the threshold degree, the process proceeds to step S104. Here, the degree of separation from the normal fluctuation range of the effective value of the driving current may be the effective value of the driving current at one time, or may be the effective values of the driving current at a plurality of times.

(Step S103) When it is determined in step S102 that the degree of separation from the normal fluctuation range of the effective value of the driving current is equal to or greater than the threshold degree, the control unit 451 increases the motor output.

In this way, the control unit 451 changes the method of controlling the motor 33 during the stop process in accordance with the degree of separation from the normal fluctuation range as a comparison result with respect to the target state quantity at the time of the process of stopping the target vacuum pump.

In accordance with this configuration, the reaction product deposited in the gap between the rotors or between the rotor and the casing can be dropped by changing the method of controlling the motor during the stop process in accordance with the degree of separation from the normal fluctuation range. In this way, since the probability of reactivating the vacuum pump can be increased, it is possible to reduce the generation frequency of maintenance or replacement of the vacuum pump.

(Step S104) Next, the control unit 451 determines whether the amount of change in the degree of separation from the normal fluctuation range is equal to or greater than the threshold change amount. When the amount of change in the degree of separation from the normal fluctuation range is less than the threshold change amount, the process proceeds to step S106.

(Step S105) When it is determined in step S104 that the amount of change in the degree of separation from the normal fluctuation range is equal to or greater than the threshold change amount, the control unit 451 increases the motor output.

In this way, the control unit 451 changes the method of controlling the motor 33 during the stop process in accordance with the amount of change in the degree of separation from the normal fluctuation range as a comparison result with respect to the target state quantity at the time of the process of stopping the target vacuum pump.

In accordance with this configuration, the reaction product deposited in the gap between the rotors or between the rotor and the casing can be dropped by changing the method of controlling the motor during the stop process in accordance with the amount of change in the degree of separation from the normal fluctuation range. In this way, since the probability of reactivating the vacuum pump can be increased, it is possible to reduce the generation frequency of maintenance or replacement of the vacuum pump.

(Step S106) Next, the control unit 451 determines whether the number of times of a deviation from the normal fluctuation range of the effective value of the driving current is equal to or greater than the threshold number of times. When the number of times of a deviation from the normal fluctuation range of the effective value of the driving current is less than the threshold number of times, the process proceeds to step S108.

(Step S107) When it is determined in step S106 that the number of times of a deviation from the normal fluctuation range of the effective value of the driving current, is equal to or greater than the threshold number of times, the control unit 451 increases the motor output.

Instead of the number of times of a deviation from the normal fluctuation range of the effective value of the driving current, the frequency of a deviation from the normal fluctuation range of the effective value of the driving current may be used. In this way, the control unit 451 changes the method of controlling the motor 33 during the stop process in accordance with the number of times or the frequency of a deviation from the normal fluctuation range as the comparison result with respect to the target state quantity at the time of the process of stopping the target vacuum pump.

In accordance with this configuration, the reaction product deposited in the gap between the rotors or between the rotor and the casing can be dropped by changing the method of controlling the motor during the stop process in accordance with the number of times or frequency of a deviation from the normal fluctuation range. In this way, since the probability of reactivating the vacuum pump can be increased, it is possible to reduce the generation frequency of maintenance or replacement of the vacuum pump.

(Step S108) Next, the control unit 451 determines whether the index (for example, the change rate, the change amount) representing the change in the frequency of a deviation from the normal fluctuation range of the effective value of the driving current is equal to or greater than the change threshold. When the frequency of a deviation from the normal fluctuation range of the effective value of the driving current is less than the change threshold, the process returns to step S101.

(Step S109) When it is determined in step S108 that the index representing the change in the frequency of a deviation from the normal fluctuation range of the effective value of the driving current is equal to or greater than the change threshold, the control unit 451 increases the motor output and the process returns to step S101.

As described above, the control unit 451 changes the method of controlling the motor during the stop process in accordance with the change in the frequency of a deviation from the normal fluctuation range as the comparison result with respect to the target state quantity at the time of the process of stopping the target vacuum pump.

In accordance with this configuration, the reaction product deposited in the gap between the rotors or between the rotor and the casing can be dropped by changing the method of controlling the motor during the stop process in accordance with the change in the frequency of a deviation from the normal fluctuation range. In this way, since the probability of reactivating the vacuum pump can be increased, it is possible to reduce the generation frequency of maintenance or replacement of the vacuum pump.

As described above, the control device 4 according to the present embodiment is a control device that controls the target vacuum pump 3 including the motor 33. The decision unit 452 decides, using at least one of target state quantities at the time of the past stop process of the target vacuum pump or another vacuum pump wherein the target state quantities are state quantities that fluctuate in accordance with the load at the time of the process of stopping the vacuum pump 3, the normal fluctuation range or the normal time fluctuation behavior of the target state quantity at the time of the stop process. The control unit 451 controls the motor 33, compares the target state quantity at the time of the process of stopping the target vacuum pump 3 with the normal fluctuation range or a normal time fluctuation behavior, and changes the method of controlling the motor 33 during the stop process depending on the comparison result.

With this configuration, the reaction product deposited in the gap between the rotors or between the rotor and the casing can be dropped by changing the method of controlling the motor 33 during the stop process. In this way, since the probability of reactivating the vacuum pump 3 can be increased, it is possible to reduce the generation frequency of maintenance or replacement of the vacuum pump 3. As a result, the cost for maintenance or replacement of the vacuum pump 3 can be reduced.

In the present embodiment, as mentioned above, as an example, it has been described that changing the method of controlling the motor during the stop process includes changing an output of the motor during the stop process. In accordance with this configuration, when the target state quantity at the time of the process of stopping the target vacuum pump is abnormal as compared with the normal fluctuation range or the normal time fluctuation behavior, the reaction product deposited in the cap between the rotors or between the rotor and the casing can be dropped by changing the output of the motor during the stop process. In this way, since the probability of reactivating the vacuum pump can be increased, it is possible to reduce the generation frequency of maintenance or replacement of the vacuum pump.

In the present embodiment, as an example, it has been described that the change of the method of controlling the motor during the stop process is to change the output of the motor 33 during the stop process (specifically, for example, to increase the output of the motor), but the present invention is not limited to this.

As shown in FIG. 9, the change of the method of controlling the motor 33 during the stop process may be to change the on and/or off period of the motor 33 during the stop process.

FIG. 9 is a diagram showing an example of changing the ON period of the motor 33 during the stop process. Deviation from the normal fluctuation range is assumed to be the abnormality generation, and in the case of FIG. 9, the threshold frequency of the abnormality generation frequency is set to 0.7. In FIG. 9, when the abnormality generation frequency reaches 0.7, since the value is equal to or greater than the threshold frequency of the abnormality generation frequency, the control unit 451 prolongs the motor-ON time (time t2 in FIG. 4) from 100 seconds to 200 seconds. As a result, it is possible to prolong the time to shake off the solidified or liquefied product in the vacuum pump.

In this way, when the target state quantity at the time of the process of stopping the target vacuum pump is abnormal as compared with the normal fluctuation range or the normal time fluctuation behavior, the reaction product deposited in the gap between the rotors or between the rotor and the casing can be dropped by changing the of ON and/or OFF period of the motor during the stop process. In this way, since the probability of reactivating the vacuum pump can be increased, it is possible to reduce the generation frequency of maintenance or replacement of the vacuum pump.

As shown in FIG. 9, when the abnormality generation frequency, which is 0.35, is lower than the threshold frequency after prolonging the motor-ON time to 200 seconds, the control unit 451 may shorten the motor-ON time (time t2 in FIG. 4) from 200 seconds to 150 seconds.

Alternatively, the change of the method of controlling the motor 33 during the stop process may be a change in the rotation direction of the motor 33 during the stop process. For example, the normal rotation and the reverse rotation may be repeated alternately such that the motor is in the normal rotation in a certain motor-ON time and the reverse rotation in the next motor-ON time.

In accordance with this configuration, when the target state quantity at the time of the process of stopping the target vacuum pump is abnormal as compared with the normal fluctuation range or the normal time fluctuation behavior, the reaction product deposited in the gap between the rotors or between the rotor and the casing can be dropped by changing the direction of rotation of the motor during the stop process. In this way, since the probability of reactivating the vacuum pump can be increased, it is possible to reduce the generation frequency of maintenance or replacement of the vacuum pump.

The above-described target vacuum pump may be a pump in a vacuum evacuation unit in which two pumps are accommodated in one housing.

Modification

Figure 10:
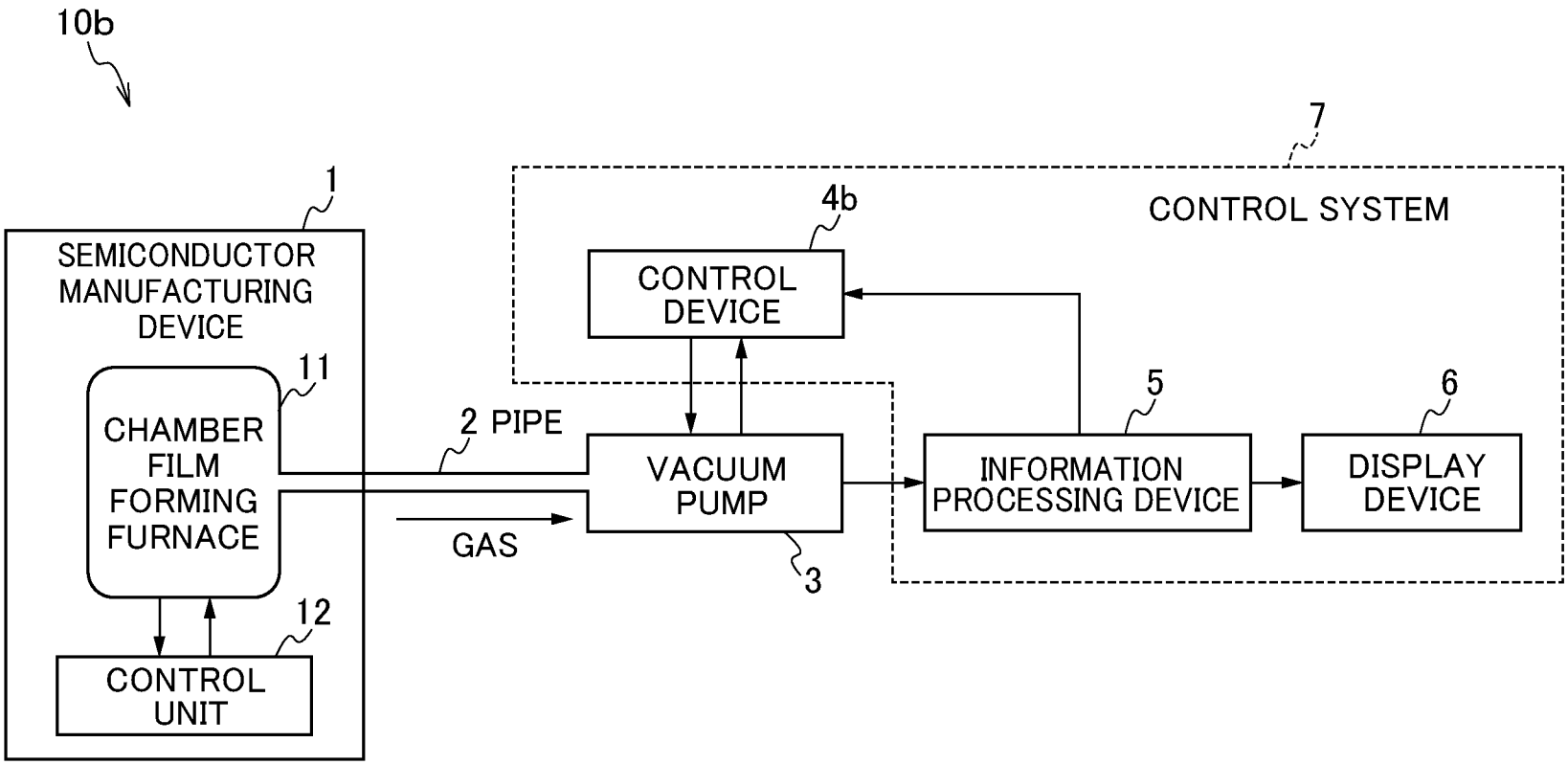
FIG. 10 is a schematic configuration diagram of a semiconductor manufacturing system 10*b* in accordance with a modification.

Subsequently, a modification will be described. FIG. 10 is a schematic configuration diagram of a semiconductor manufacturing system 10*b* according to the modification. As shown in FIG. 10, the semiconductor manufacturing system 10*b* includes a control system 7, and the control system 7 has a control device 4*b*, an information processing device 5, and the display device 6.

In the semiconductor manufacturing system 10*b* according to the modification, the functions of the decision unit 452 and the determination unit 453 included in the control device 4 according to the present embodiment are included in the information processing device 5.

Figure 11:
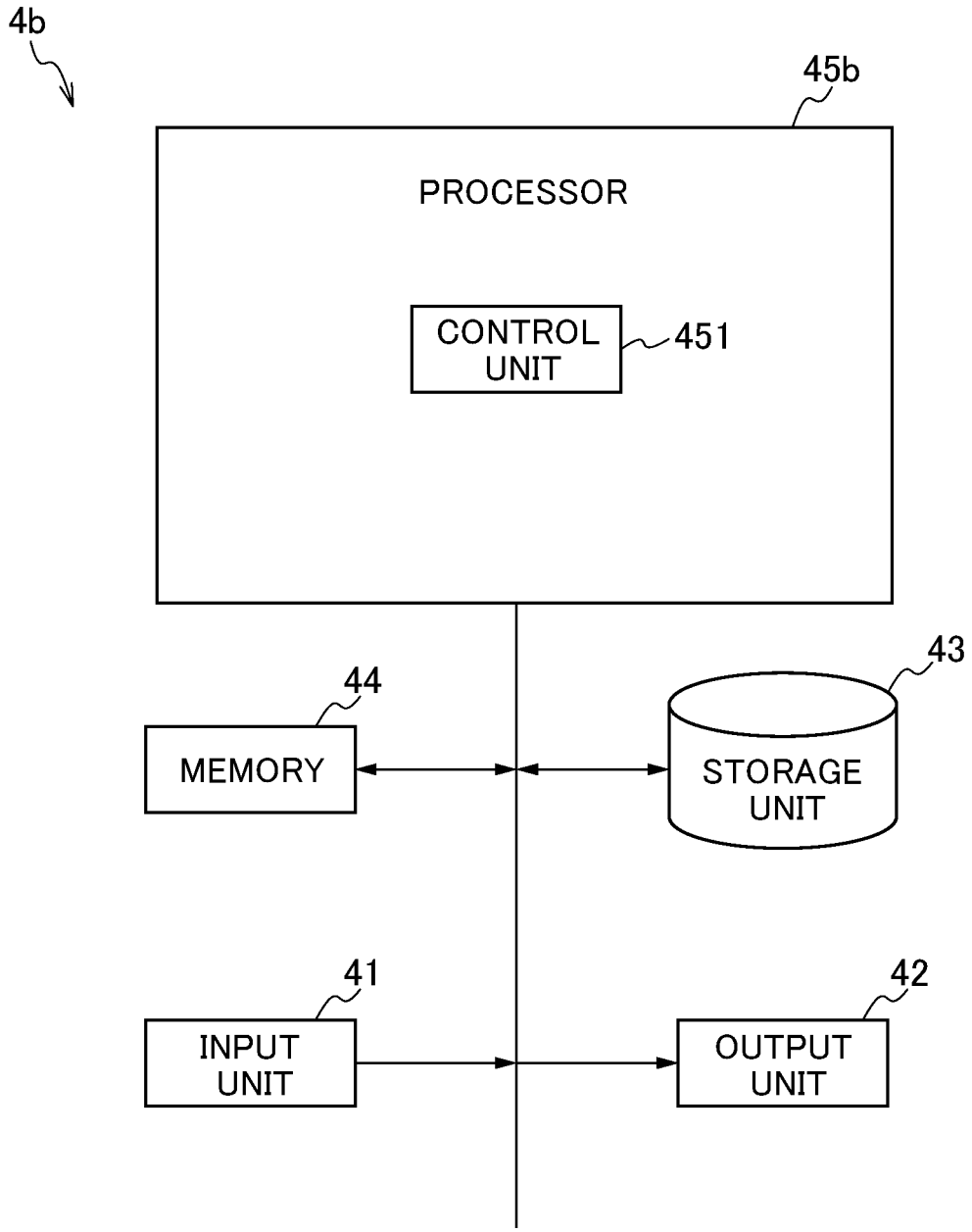
FIG. 11 is a block diagram showing a schematic configuration of a control device 4*b* in accordance with a modification.

FIG. 11 is a block diagram showing a schematic configuration of the control device 4*b* according to the modification. As shown in FIG. 11, in the control device 4*b* according to the modification, as compared with the control device 4 according to the present embodiment, the CPU 45 is changed to the CPU 45*b*, and the CPU 45*b* does not function as the decision unit 452 and the determination unit 453.

Figure 12:
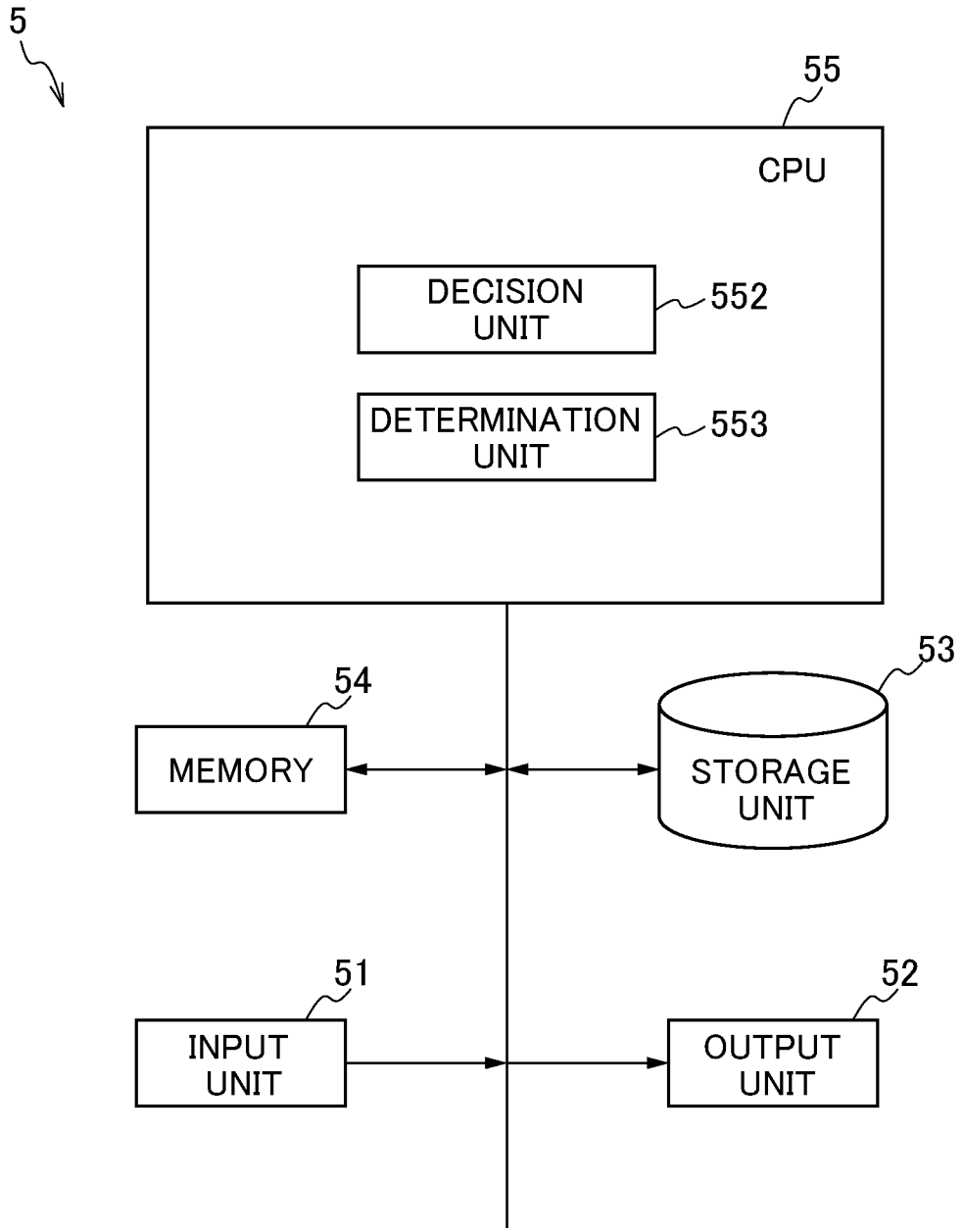
FIG. 12 is a block diagram showing a schematic configuration of an information processing device 5 in accordance with a modification.

FIG. 12 is a block diagram showing a schematic configuration of the information processing device 5 according to the modification. As shown in FIG. 11, the information processing device 5 includes an input unit 51, an output unit 52, a storage unit 53, a memory 54, and the CPU (Central Processing Unit) 55.

The input unit 51 is connected to the inverter 39 and the pressure gauge 61, and the current effective value of the driving current, the rotation speed of the motor 33, and the pressure value in the vacuum pump 3 are input to the input unit 51. The output unit 52 outputs information in accordance with a command from the CPU 55. The storage unit 53 stores a program to be executed by the CPU 55. The memory 54 temporarily stores information.

The CPU 55 functions as a decision unit 552, and a determination unit 553 by reading the program from the storage unit 53 and executing it. Since the decision unit 552 has the same function as the decision unit 452 included in the control device 4 of the present embodiment, and the determination unit 553 has the same function as the determination unit 453 included in the control device 4 of the present embodiment, a detailed description thereof will be omitted.

It is to be noted that the present invention is not limited to the above configuration, and the control system including a plurality of devices may perform the processes of the control device according to the present embodiment or the control device according to the modification, and the information processing device in a distributed manner by the plurality of devices. Further, the above-described various processes related to the control device according to the present embodiment or the information processing device according to the modification may be performed so that a program for executing each processing of the control device according to the present embodiment or the information processing device according to the modification is recorded in a computer readable recording medium, and the program recorded in the recording medium is read by a computer system and executed by the processor.

Further, in the present embodiment, the current effective value of the driving current is used as the target state quantity which is a state quantity which fluctuates in accordance with the load at the time of the process of stopping the vacuum pump 3, but the present invention is not limited to this. For example, the target state quantity may be the driving current of the motor included in the vacuum pump, the electric power of the motor, the rotation number of the rotor, the temperature of the vacuum pump, the pressure in the vacuum pump, the vibration frequency of the vacuum pump, or the like. Also, the target state quantity may be used after filtering the target state quantity with a predetermined filter, or may be used after averaging it.

Each processing by the control device according to the present embodiment, or the control device and the information processing device according to the modification is implemented by, for example, artificial intelligence (AI) such as quantum computing, neural network such as deep learning, or machine learning. For example, supervised learning may be performed by using the target state quantity at the time of the past stop process of the target vacuum pump or other vacuum pump as teacher data.

The processes of the decision unit 452 and the determination unit 453 according to the present embodiment, or the processing in the information processing device according to the modification may be performed in the cloud, or may be performed from a terminal device (so-called edge) connected to an information processing device such as a server via a communication network.

For example, as the edge terminal on which the logic for performing the processing of the decision unit 452 and the determination unit 453 according to the present embodiment, or the processing in the information processing device according to the modification is implemented, the controller applying a fieldbus (a standard for exchanging signals between field devices and controllers operating in factories, etc. using digital communication) according to which communication cart be performed at high speed by open architecture (logical structure of computer system), more specifically, the controller compatible with PLC 5 language or C language in accordance with IEC 61131-3 (the standard defined by the International Electrotechnical Commission (IEC) December 1993, where a programming language for PLC (Programmable Logic Controller) is defined) can be used.

Note that the determination unit 553 may have a function of generating a new determination algorithm as to whether reactivation is possible from the comparison result between the target state quantity at the time of the process of stopping the target vacuum pump and the past normal fluctuation range or the past normal time fluctuation behavior, the amount of control of the motor during the stop process, and the reactivation result.

Specifically, for example, when reactivation cannot be performed, from the comparison result at this time and the amount of control of the motor during the stop process, it can be recognized that the reactivation is not possible, so that the determination unit 553 updates the determination standard in the determination algorithm. Along with this, the determination unit 553 performs control so as to improve the amount of control of the motor during the stop process so that reactivation can be performed when the same comparison result is given next. In this way, since a new determination algorithm is automatically generated, algorithm development time and cost can be reduced.

Figure 13:
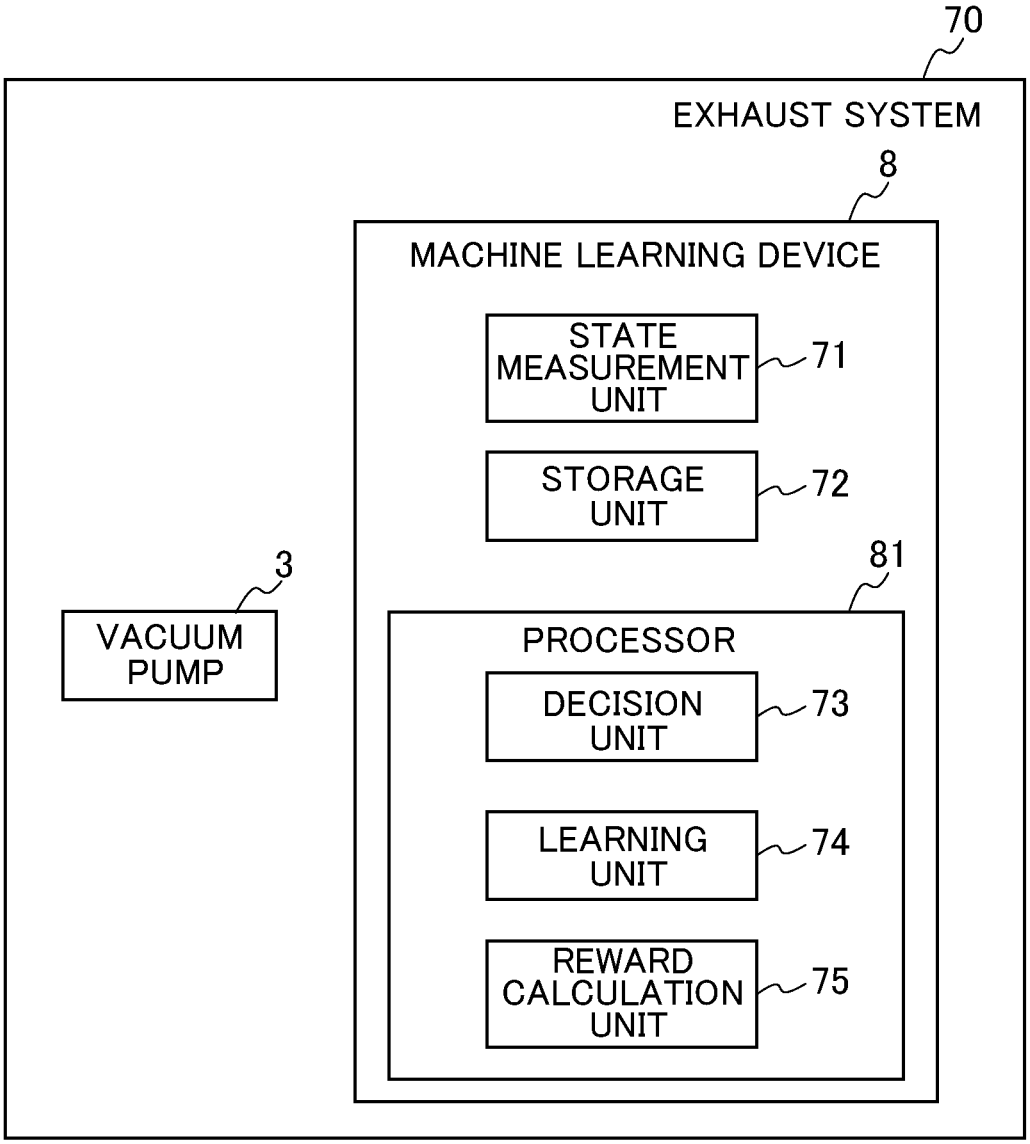
FIG. 13 is a block diagram showing a schematic configuration of a machine learning device according to another embodiment.

As shown in FIG. 13, a machine learning device for learning a method of controlling, in an exhaust system having at least one vacuum pump, at least one motor of the at least one vacuum pump may be provided.

FIG. 13 is a block diagram showing a schematic configuration of a machine learning device according to another embodiment. An exhaust system 70 includes the vacuum pump 3 and a machine learning device 8. The exhaust system 70 is, for example, a semiconductor manufacturing system as in the present embodiment.

As shown in FIG. 13, the machine learning device 8 includes a state measurement unit 71, a storage unit 72, and a processor 81.

The state measurement unit 71 measures the target state quantity which is a state quantity fluctuating in accordance with the time of the process of stopping the vacuum pump in the vacuum pump during the performance of the stop process. The state measurement unit 71 is, for example, a measurement instrument or a sensor. Specifically, for example, the state measurement unit 71 may be the pressure gauge 61 that measures the pressure value in the vacuum pump 3, the thermometer 62 that measures the temperature inside the vacuum pump 3, a vibration sensor that detects the vibration of the vacuum pump 3, a displacement sensor that detects the displacement of the vacuum pump 3, or an acceleration sensor that detects the acceleration of the vacuum pump 3.

The storage unit 72 stores the pump stop control pattern of the target state quantity at the time of the process of stopping the target vacuum pump or another vacuum pump. The storage unit 72 stores a program to be executed by the processor 81. The processor 81 functions as a decision unit 73, a learning unit 74, and a reward calculation unit 75 by reading and executing the program from the storage unit 72.

The decision unit 73 uses at least one of the target state quantity data at the time of the past stop process of the target vacuum pump or another vacuum pump read from the storage unit, and decides the normal fluctuation range or the normal time fluctuation behavior of the target state quantity at the time of the stop process.

The learning unit 74 controls the motor of the target vacuum pump, and compares the target state quantity at the time of the process of stopping the target vacuum pump of the object with the normal fluctuation range or the normal time fluctuation behavior. When it is determined that there is no deviation after determining presence or absence of a deviation from the normal fluctuation range of the target state quantity at the time of the process of stopping the target vacuum pump, the learning unit 74 updates the normal fluctuation range or the normal time fluctuation behavior of the target state quantity at the time of the stop process to cause the storage unit to store the update data, and when it is determined that there is a deviation the learning unit 74 updates the method of controlling the motor during the stop process in accordance with the degree of deviation.

The reward calculation unit 75 calculates, based on the measured target state quantity, a reward for the result of updating the method of controlling the motor during the stop process is calculated.

Specifically, for example, when the motor torque at the time of activation exceeds the reference value or when activation is not possible, the reward calculation unit 75 judges the result as abnormal and calculates that there is no reward. On the other hand, for example, when the motor torque at the time of activation does not exceed the reference value and the normal operation is performed, the reward calculation unit 75 calculates that there is a reward and add the set value to the reward.

The target state quantity includes at least one of the driving current of the motor included in the at least one vacuum pump, the electric power of the motor, the rotation number of the rotor, the temperature of the vacuum pump measured by the temperature sensor, the pressure in the vacuum pump measured by the pressure sensor, and the vibration frequency of the vacuum pump measured by the vibrometer.

The learning unit 74 learns a method of controlling at least one motor of the vacuum pump so that the reward is improved by repeating the update of the method of controlling the motor. In this way, since the method of controlling the motor is automatically learned and the reactivation probability is improved, algorithm development time and cost can be reduced.

In addition to the above configuration, the machine learning system including a plurality of devices may perform each process of the machine learning device according to another embodiment in a distributed manner by the plurality of devices. Further, various processes of the processor of the machine learning device according to another embodiment may be performed so that a program for executing each processing of the processor of the machine learning device according to another embodiment is recorded in a computer readable recording medium, and the program recorded in the recording medium is read by a computer system and executed by the processor.

As described above, the present invention is not limited to the above embodiment as it is, and the constituent elements can be modified and materialized without departing from the gist thereof in the implementation stage. For example, in another embodiment, a momentum transport pump such as a turbo molecular pump can be used as a vacuum pump. Alternatively, in addition to the vacuum pump employed in the exhaust system for exhausting the gas used in the semiconductor manufacturing process, for example, the embodiment can also be applied to a vacuum pump used for an exhaust system for medical use and analysis equipment. In addition, various inventions can be formed by appropriately combining a plurality of constituent elements disclosed in the above embodiment. For example, some constituent elements may be deleted from all the constituent elements shown in the embodiment. Further, the constituent elements of different embodiments may be appropriately combined.

REFERENCE SIGNS LIST

1 Semiconductor manufacturing device
10 Semiconductor manufacturing system
11 Chamber film forming furnace
12 Control unit
2 Pipe
3 Vacuum pump
31 Rotor
32 Casing
33 Motor
38 Power supply
39 Inverter
4 Control device
41 Input unit
42 Output unit
43 Storage unit
44 Memory
45 Processor
451 Control unit
452 Decision unit
453 Determination unit
5 Information processing device
6 Display device
61 Pressure gauge
62 Thermometer
7 Control system
8 Machine learning device
70 Exhaust system
71 State measurement unit
72 Storage unit
73 Decision unit
74 Learning unit
75 Reward calculation unit
81 Processor

What is claimed is:

1. A control device that controls a target vacuum pump including a motor, the control device comprising:

a decision unit that decides, using at least one of target state quantities at a time of a past stop process of the target vacuum pump or another vacuum pump of the same type as the target vacuum pump wherein the target state quantities are state quantities which fluctuate in accordance with a load at a time of a process of stopping a vacuum pump, a normal fluctuation range or a normal time fluctuation behavior of the target state quantity at the time of the stop process, the stop process being a process from the start of control to stop to the completion of stop; and a control unit that controls the motor;

wherein the control unit changes the method of controlling the motor during the stop process in accordance with an amount of change in a degree of separation from the normal fluctuation range as the comparison result with respect to the target state quantity at the time of the process of stopping the target vacuum pump, or the control unit changes the method of controlling the motor during the stop process in accordance with the number of times or a frequency of a deviation from the normal fluctuation range as the comparison result with respect to the target state quantity at the time of the process of stopping the target vacuum pump, or the control unit changes the method of controlling the motor during the stop process in accordance with a change in the frequency of the deviation from the normal fluctuation range as the comparison result with respect to the target state quantity at the time of the process of stopping the target vacuum pump.

2. The control device according to claim 1, wherein the control unit changes the method of controlling the motor during the stop process in accordance with a degree of separation from the normal fluctuation range as the comparison result with respect to the target state quantity at the time of the process of stopping the target vacuum pump.

3. The control device according to claim 1, wherein changing the method of controlling the motor during the stop process includes changing an output of the motor during the stop process.

4. The control device according to claim 1, wherein changing the method of controlling the motor during the stop process includes changing an ON period and/or an OFF period of the motor during the stop process.

5. The control device according to claim 1, wherein changing the method of controlling the motor during the stop process includes changing a rotation direction of the motor during the stop process.

6. The control device according to claim 1, further comprising a determination unit determining whether reactivation after an operation of the vacuum pump is stopped is possible by comparing the target state quantity at the time of the stop process of the target vacuum pump with the normal fluctuation range or the normal time fluctuation behavior.

7. A control system that controls a target vacuum pump including a motor, the control system comprising:

a decision unit that decides, using at least one of target state quantities at a time of a past stop process of the target vacuum pump or another vacuum pump of the same type as the target vacuum pump wherein the target state quantities are state quantities which fluctuate in accordance with a load at a time of a process of stopping a vacuum pump, a normal fluctuation range or a normal time fluctuation behavior of the target state quantity at the time of the stop process, the stop process being a process from the start of control to stop to the completion of stop; and a control unit that controls the motor, wherein the control unit changes the method of controlling the motor during the stop process in accordance with an amount of change in a degree of separation from the normal fluctuation range as the comparison result with respect to the target state quantity at the time of the process of stopping the target vacuum pump, or the control unit changes the method of controlling the motor during the stop process in accordance with the number of times or a frequency of a deviation from the normal fluctuation range as the comparison result with respect to the target state quantity at the time of the process of stopping the target vacuum pump, or the control unit changes the method of controlling the motor during the stop process in accordance with a change in the frequency of the deviation from the normal fluctuation range as the comparison result with respect to the target state quantity at the time of the process of stopping the target vacuum pump.

8. A non-transitory computer readable recording medium storing a program, the program causing a control device that controls a target vacuum pump including a motor to function as:

a decision unit that decides, using at least one at target state quantities at a time of a past stop process of the target vacuum pump or another vacuum pump of the same type as the target vacuum pump wherein the target state quantities are state quantities which fluctuate in accordance with a load at a time of a process of stopping a vacuum pump, a normal fluctuation range or a normal time fluctuation behavior of the target state quantity at the time of the stop process, the stop process being a process from the start of control to stop to the completion of stop; and a control unit changing the method of controlling the motor during the stop process in accordance with an amount of change in a degree of separation from the normal fluctuation range as the comparison result with respect to the target state quantity at the time of the process of stopping the target vacuum pump, or changing the method of controlling the motor during the stop process in accordance with the number of times or a frequency of a deviation from the normal fluctuation range as the comparison result with respect to the target state quantity at the time of the process of stopping the target vacuum pump, or changing the method of controlling the motor during the stop process in accordance with a change in the frequency of the deviation from the normal fluctuation range as the comparison result with respect to the target state quantity at the time of the process of stopping the target vacuum pump.

* * * * *